US007021987B1

(12) United States Patent
Lund et al.

(10) Patent No.: US 7,021,987 B1
(45) Date of Patent: Apr. 4, 2006

(54) BOTTLE ROCKET LAUNCHER

(76) Inventors: Niles Lee Lund, 1550 Finntown Rd., Waldoboro, ME (US) 04572; Richard Edward Thibodeau, 395 Youngtown Rd., Lincolnville, ME (US) 04849-5428

( * ) Notice: Subject to any disclaimer, the term of this patent is extended or adjusted under 35 U.S.C. 154(b) by 149 days.

(21) Appl. No.: 10/849,373

(22) Filed: May 20, 2004

(51) Int. Cl.
*A63H 27/26* (2006.01)

(52) U.S. Cl. ..... 446/212

(58) Field of Classification Search ..... 446/56, 446/187, 211, 212, 400; 124/56, 57, 61, 124/63, 69, 70, 75
See application file for complete search history.

(56) References Cited

U.S. PATENT DOCUMENTS 2,927,398 A 3/1960 Kaye et al.
5,839,940 A * 11/1998 Ensmenger ..... 446/212
5,881,706 A * 3/1999 Carson ..... 124/69
6,315,629 B1 11/2001 Jones
6,957,526 B1 * 10/2005 Lin ..... 60/221

OTHER PUBLICATIONS

Science Source Catalog, 1999-2000 edition, p. 26.
Jake Winemiller, Water Rockets 1-111 Teacher Handbook, Appendix A, p. 94, Copyright 1994, INSIGHTS Visual Productions Inc.

* cited by examiner

*Primary Examiner*—Kien Nguyen

(57) ABSTRACT

A water bottle rocket system for launching single rockets, multistage rockets, multiengine rockets or multistage multiengine rockets. Rocket bodies are comprised of ordinary plastic beverage bottles. The propellant used is preferably water and compressed air. The system offers adjustable launch supports to vary the launch angle for both single engine or multiple engine rockets. A charging manifold is provided for charging with liquid or gas propellant. Multiengine rockets are simultaneously charged with propellant through launch base internal channels.

30 Claims, 9 Drawing Sheets

BOTTLE ROCKET LAUNCHER

BACKGROUND INFORMATION

1. Field of the Invention

The present invention generally relates to the field of rocket launchers and more particularly to multi-stage rocket launchers and more particularly to parallel or ganged multi-stage rocket launchers.

2. Description of Prior Art

Rocket launchers are popular with hobby enthusiasts and are used as educational tools to engage students in discovering the laws of physics while solving practical engineering problems. The dramatic release of stored energy during a launch enthralls students. This will peak student interest and lead students to questions concerning physical properties such as acceleration, inertia, friction, aerodynamic drag, and flight distance. Students gain experience in engineering by designing and testing their own nose cones, recovery systems or stabilizing fins.

Budgetary restraints require school systems to purchase inexpensive educational systems. In spite of some restraints the apparatus must be safe to use and rugged enough to withstand years of laboratory and field use. Several bottle rocket launchers are known. Kaye (U.S. Pat. No. 2,927,398; 1960) discloses a multi-stage bottle rocket launcher. There are several disadvantages of the Kay system: It lacks versatility and economy of design by not allowing use with a conventional soda bottle. The geometry of the design is complex making it expensive to manufacture. There is no mechanism to prevent pressure leaks from the second-stage into the first stage prior to its separation from the first stage. The base is a combination pressure pump as well as a lock and release mechanism. The Kaye design does not allow use of pressure pumps, such as the ordinary bicycle type, which are widely available. A safety issue exists due to the close proximity of the pressure pump and pressurized rocket body.

Jones (U.S. Pat. No. 6,315,629; 2001) discloses a single stage rocket launcher. There are several disadvantages of the Jones launcher. The release mechanism is not suitable for multi-stage applications. The release mechanism utilizes pivotable gripping levers that require assembly thereby increasing costs. Pressurization and water filling is not provided by the same fueling line. The pressure gauge is located at the base of the launcher therefore reading the gauge requires being in close proximity of the pressurized rocket. The safety pin and the release mechanism are attached to a single pull line. The base is not adjustable for uneven terrain. The base can not be adjusted to vary the launch angle.

Prior art discloses no launcher that is capable of launching rockets with stages greater than two. No launcher is capable of simultaneously launching rockets in parallel either singly or ganged. No launcher is capable of launching multistage-ganged rockets. There is no launcher capable of adjusting the lift off angle or leveling the launcher for uneven terrain. Furthermore, no launcher supplies a charging system that utilizes a single line for both liquid and gas charging. Nor do the launchers provide a pressure gauge a safe distance from the pressurized rocket. The disclosed launchers are structurally more complicated and thus increases the cost of manufacture.

What is needed is a launcher that is inexpensive, rugged, modular and safe to operate. What is further needed is a launcher that can adjust to the variability of launch conditions. What is still yet further needed is a launcher capable of launching single stage rockets or simultaneously launching multiple, single stage rockets or launching multiple, multistage rockets as well as ganged rockets or ganged multistage rockets.

SUMMARY OF THE INVENTION

Accordingly it is the primary object of the invention to provide a bottle rocket launching system that is safe to operate, modular in design, easy to assemble and affordable. A further object of the invention is to provide a launcher capable of launching single stage rockets or multistage rockets. A still further object is to provide a launcher able to simultaneously launch several single-stage or multi-stage rockets as well as launch a ganged single stage or a ganged multi-stage rocket as a single unit. An even further object is to provide a charging station that safely charges all first-stage and subsequent stage rockets.

In accordance with the teachings herein, the present invention provides a bottle rocket launching system with a plurality of pivotable supports. Said pivotable supports are capable of adjusting for uneven terrain or changing the launch angle. The bottle rocket launching system provides a modular, capture and release mechanism that is utilized in single rocket launches, all stages of multi-stage launches, and in ganged rocket launches. Said bottle rocket launching system has a charging station used to charge bottles of the ordinary soda bottle type or any other vessel of similar construction, with fluids such as water and compressed gas. Said charging station is located a safe distance from charged rocket and charges through a single line. Said charging station is equipped with a pressure reading device.

In greater detail, the support structure has a support hub that has a plurality of pivotable supports circumferrentialy placed. Said pivotable supports are attached to support hub with ordinary fasteners. The pivotable supports are adjusted for uneven terrain or are set to change the launch angle and are secured in position by said ordinary fasteners.

The capture and release mechanism, in the preferred embodiment, is comprised of a capture and release core with a plurality of ordinary seal rings. Said seal rings prevent fluid leakage from the launch vessel prior to launch. Said capture and release mechanism has a central bore that allows passage of charging fluids into rocket vessel. Said capture and release core supports flexible retainers that are circumferentially placed around said capture and release core.

The capture and release mechanism is secured to the support structure by a capture and release fastener. Said capture and release fastener is inserted into the lower end of the release core. Charging fluid is prevented from escaping said capture and release fastener and support structure contact area by ordinary seal rings. The capture and release fastener has a central bore that allows passage of charging fluid into said capture and release core. Said capture and release fastener has internal means to prevent charging fluid from flowing back from the rocket vessel.

Said flexible retainers provide a lock means to secure the rocket vessel to said support structure when rocket vessel is pressurized with compressed gas. The rocket vessel can be an ordinary soda bottle or any vessel with a flange capable of communication with said flexible retainers. A capture and release cup is slid into position that is furthest away from support structure. When in this position the flexible retainers will rest inside said capture and release cup. The inner side walls of the capture and release cup prevent radial movement of the flexible retainers thereby locking the ends of the flexible retainers around the flange located on the neck of the rocket vessel. In this lock position, the rocket vessel is prevented from launching when the rocket vessel is pressurized with compressed gas.

A launch-actuating device is provided to remotely launch the rocket vessel from a safe distance. Said launch actuating device may be any device that causes movement of the capture and release cup downward towards the support structure. Said launch-actuating device may be a simple tether, such as a string, or a more complicated mechanism such as an electrical or electronic device may also be used.

A safety control clip is inserted to insure that the capture and release cup is maintained in this lock position. In the preferred embodiment the safety control dip fits partially around the release core between the capture and release cup and the support structure or the previous stage rocket vessel and thereby prevents downward movement of the capture and release cup. Said safety control dip is controlled remotely by any safety release device that would allow removal of said safety control clip. The simplest said safety release device would be a tether such as a string or a more complicated said safety release device such as an electrical or electronic device may also be used. Said safety release device can be independent of said launch actuating device. This embodiment increases safety during launch operations by placing launch approval, removal of said safety control clip, and launch initiate, by downward motion of said capture and release cup, under separate, independent control. The aforesaid description is complete for a single stage rocket.

If desired, a second-stage may be added. Said second-stage is added to the first-stage by providing a mounting hole in the end of said first-stage rocket vessel that is opposite to the thrust orifice. The modular design of said capture and release mechanism allows said capture and release mechanism to be mounted in said mounting hole. Said second-stage capture and release mechanism is mounted in the same manner described for the single stage rocket. An additional safety control clip is used to prevent premature release of the second-stage rocket. An additional safety release device is needed to remove said additional safety control clip. For reasons to be explained below there is no launch-actuating device required for said second-stage operation.

Subsequent stages may also be added. To add three or more stages, mounting holes are provided in the rocket vessel end, opposite to the thrust orifice end, of every stage except the last stage. Identical capture and release mechanisms are mounted in said mounting hole as described above. The safety control clip is identical to previous stages with the following exception. A stage separation delay device is incorporated into said safety control clip. Said stage separation delay device replaces said safety release device. Said stage separation delay device would be a simple tether that is attached to said third-stage safety control clip and to some point on the first stage rocket vessel. If subsequent stages are incorporated an additional separation delay device is needed. For example, a fourth-stage would require a stage separation delay device to be connected to the fourth-stage safety control clip with the other end of the stage separation device connected to the second-stage rocket. In this embodiment subsequent stage safety control clips prevents movement of the capture and release cup, of said subsequent stages, until the previous stage separation has occurred. More elaborate methods for stage separation delay devices such as an electrical or electronic device may also be used. Stage separation is discussed in greater detail below.

A charging station is provided to fill the said first-stage rocket vessel with liquid propellant and all stages with pressurized gas. Said charging station has two inlets and a single outlet. One inlet provides a connection to a liquid propellant source, usually water or any non-reactive liquid, and the other inlet provides a connection to a compressed gas source. Said compressed gas may be air or any other inert gas. Said charging station single outlet is connected to the central bore of said first-stage capture and release fastener. Said charging station has internal back flow prevention devices to ensure that the liquid propellant does not enter the compressed gas source and the compressed gas does not enter the liquid propellant source. A pressure gauge is mounted on said charging station to allow reading of the rocket vessel pressure at a safe distance from the pressurized rocket vessel.

Operation of a three-stage rocket launch is as follows. Mount first-stage rocket vessel by placing bottle rocket neck orifice over capture and release core until flexible retainers are in communication with bottle neck flange. The capture and release cup is then slid up to the lock position. The safety control clip is then place around capture and release core bottom. The safety release device is attached the safety control clip and in the case of a simple tether is lead to a position a safe distance away from the multi-stage water rocket system.

The second-stage is mounted by first partially filling the second-stage rocket vessel with liquid propellant. The second-stage rocket vessel outlet orifice is slid around the second stage capture and release core, mounted on first-stage rocket vessel, opposite the thrust orifice end, until flexible retainers are in communication with bottle neck flange on second-stage rocket vessel. The capture and release cup is then moved to the lock position. The safety control clip is then placed around the capture and release core between the second stage capture and release cup and the first stage rocket vessel. The safety release device is attached to the second stage safety control clip and is led to a safe distance away from the multi-stage water rocket system.

The third-stage rocket vessel is mounted on the second-stage rocket vessel in the same manner as the second-stage rocket vessel is mounted on the first-stage rocket vessel. The stage separation delay device, in this embodiment, is a simple tether with one end connected to the third stage safety control clip and the other end of said stage separation delay device fastened to the first-stage rocket assembly. The connection may be made to the first-stage rocket vessel or the capture and release core mounted on the first-stage rocket vessel.

The first-stage rocket vessel is charged with liquid propellant using the said charging station. Liquid propellant passes from the liquid propellant source into the said charging station inlet through the said charging station internal back flow prevention device. Liquid propellant then exits the said charging station and enters the said first-stage capture and release fastener central bore via the said charge line. The charge line connects charging station to the multi-stage water rocket system. Liquid propellant enters the first-stage rocket vessel via the capture and release core central bore. Liquid propellant is prevented from flowing back into the charge line by the back flow prevention means located in the capture and release fastener.

All stages are charged with compressed gas using the charging station. Compressed gas passes from the compressed gas source into the charging station compressed gas inlet. Compressed gas passes through the charging station second back flow prevention device. Compressed gas exits the charging station and enters the charge line. The charge line is connected to the first-stage capture and release fastener central bore. Compressed gas passes through the capture and release fastener back flow prevention device and enters the capture and release core central bore. The compressed gas exits the capture and release central bore and flows through the liquid propellant already contained within the first stage rocket vessel. The compressed gas accumulates in the space above the liquid propellant in the first-stage rocket vessel. The compressed gas enters the capture and release fastener central bore, mounted on the first-stage rocket vessel, and charges the second-stage rocket vessel with compressed gas in the same manner described above. Compressed gas charges the third-stage rocket vessel in the same manner as the second-stage rocket vessel. All stages are now charged with compressed gas. The multi-stage rocket system is ready for launch. It should be noted that the above explanation of operation is the same for any amount of stages incorporated.

The multi-stage rocket system is safely launched using the following procedure. Safety control clips are removed from the first-stage and the second-stage, capture and release mechanisms. The removal is initiated by actuating the respective safety release device. The multi-stage rocket system is now launched by actuating the first-stage launch-actuating device. The launch actuating device causes the first-stage capture and release cup to move to the launch position. The flexible retainers are no longer restrained from radial movement. The force caused by the pressurized gas in the first-stage rocket vessel causes all three stages to move upward. This upward movement will cause the first-stage rocket vessel 101 to separate from the capture and release mechanism 110 mounted on the support structure 104. Upon separation, liquid propellant is forced from the first-stage rocket vessel orifice by the compressed gas in the first-stage rocket vessel. All three stages well accelerate upward.

Upon initial acceleration the second-stage capture and release cup will move downward to its' release position. The second-stage is now free to separate from the first-stage but is prevented from doing so because the force of acceleration is greater than the force caused by the compressed gas in the second stage. At some point in the flight, the force caused by the compressed gas in the second-stage rocket vessel will be greater than the force of acceleration tending to keep the stages together. At this point the second-stage will separate from the first-stage and accelerate away from the first-stage carrying the third-stage with it.

Upon the initial separation of the second-stage from the first stage, the third-stage safety control clip is automatically removed. This is accomplished by the stage separation delay device connected between the first-stage and the safety control clip on the third stage. As the second and third-stage accelerate, the capture and release cup of the third-stage will slide down to its release position. The third-stage will separate and accelerate from the second-stage when forces are balanced in the same manner described above for first and second-stage separation. Additional stages operate in the same manner as the third stage.

The modular design of the capture and release mechanism allows operation in a parallel launch configuration. To accomplish this, any number of capture and release mechanisms can be mounted so rocket vessels can be loaded onto the capture and release cores without interference. The capture and release cups are connected with a coupling plate so that all capture and release mechanisms can be moved as a unit. All capture and release cups are held in the capture position by placing one safety control dip under the coupling plate. A safety release mechanism is attached to the safety control clip. A launch-actuating device is attached to the coupling plate. Placement of launch and release mechanisms with an associated coupling plate allows for parallel launches of multiple single stage rocket vessels, multiple multi-stage rockets or multiple rocket vessels ganged as a single rocket. Ganged rockets may also be multi-stage.

BRIEF DESCRIPTION OF THE DRAWINGS

The present invention is described in detail with the accompanying drawings. Identical numbers are used to reference components that are functionally equivalent. In should be noted that the drawings are not drawn to scale.

DETAILED DESCRIPTION OF THE INVENTION

Figure 1:
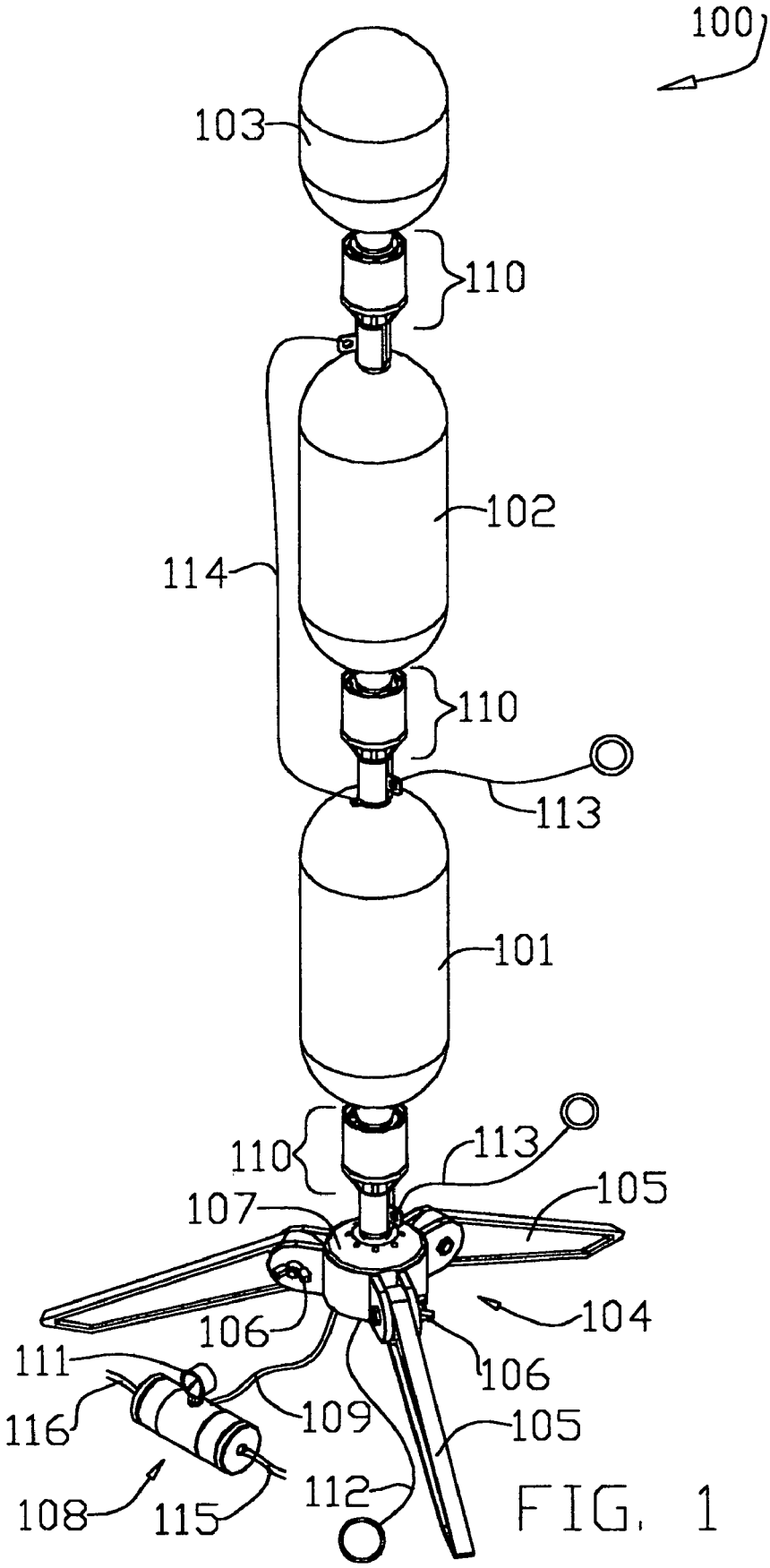
FIG. 1 is an isometric view of a multi-stage rocket system with three-stages.

Referring to FIG. 1, a multi-stage water bottle rocket system 100 is shown in a three-stage configuration. Although this detailed description explains a three-stage configuration, it is understood that additional stages are possible and that the multi-stage water bottle rocket system 100 is not limited to three stages.

The multi-stage water bottle rocket system 100 has a support structure 104. The support structure 104 has a plurality of circumferentially mounted pivotable supports 105. Pivotable supports 105 are attached to support hub 107 using ordinary fasteners 106. The pivotable supports 105 are adjusted using ordinary fasteners 106. The pivotable supports 105 are used to level the multi-stage water bottle rocket system 100 for uneven terrain or to vary the launch angle. The support hub 107 also provides an attachment point for capture and release mechanism 110.

The capture and release mechanism 110 is used in every stage of the multi-stage water bottle rocket system 100. The capture and release mechanism 110 is discussed in greater detail below.

First-stage rocket vessel 101, second-stage rocket vessel 102 and third-stage rocket vessel 103 may be any vessel that has the ability of withstanding pressurization and that is capable of communication with capture and release mechanism 110. Example of said vessel is an ordinary soda bottle or an ordinary water cooler bottle of any size or shape but said vessel is in no way limited to these types of vessels. The said rocket vessels are discussed in greater detail below.

Safety release device 113 is provided so that the safety mechanism incorporated in the capture and release mechanism 110, discussed below, can be actuated from a safe distance from the launch site. The safety release device 113 may be a simple tether; an electrical or electronic device or any mechanism capable of communication with the safety mechanism incorporated in capture and release mechanism 110.

The stage separation delay device 114 functions to delay separation of any stage, greater than the second stage, incorporated in the multi-stage water rocket system 100. The stage separation delay device 114 may be a simple tether, an electrical or electronic device or any mechanism capable of communication with the capture and release mechanism 110 that provides the proper timing for separation. The separation delay device is discussed in more detail below.

The launch-actuating device 112 functions to initiate a launch by communicating with capture and release mechanism 110. The launch actuating device 112 ensures the launch is initiated a safe distance from the pressurized vessel. The launch-actuating device 112 may be a simple tether, an electrical or electronic device. The launch-actuating device 112 may be any mechanism capable of launch communication with the capture and release mechanism 110.

Charging station 108 provides a means for remotely charging the first-stage rocket vessel 101 with liquid propellant. The charging station 108 provides a means for charging the first-stage rocket vessel 101, the second-stage rocket vessel 102, the third-stage rocket vessel 103, as well as any additional stage rocket vessel, with compressed gas. Said liquid propellant may be any liquid. The preferred liquid is generally water or any liquid that does not pose a hazard to operating personnel or observing bystanders. Said compressed gas may be any compressed gas, generally air or any compressed gas that does not pose a hazard to operating personnel or observing bystanders. Charging station 108 has two inlets. Charging station 108 liquid inlet 115 is connected to any suitable liquid source. Charging station 108 compressed gas inlet 116 is connected to any suitable compressed gas source. Charge line 109 is the fluid outlet for charging station 108. Charge line 109 is connected to capture and release mechanism 110 via the capture and release fastener 201, shown in FIG. 2. Charge line 109 provides a means for liquid propellant or compressed gas to be fed into the multi-stage water bottle rocket system 100, a safe distance from the pressurized vessel. Charging station 108 is fitted with an ordinary pressure gauge 111. Incorporating the ordinary pressure gauge 111 in the charging station 108 allows reading of the pressure supplied to multi-stage water bottle rocket system 100 a safe distance from the pressurized vessel. Charging station 108 has internal back flow prevention devices. The back flow prevention devices are discussed in greater detail below.

Figure 2:
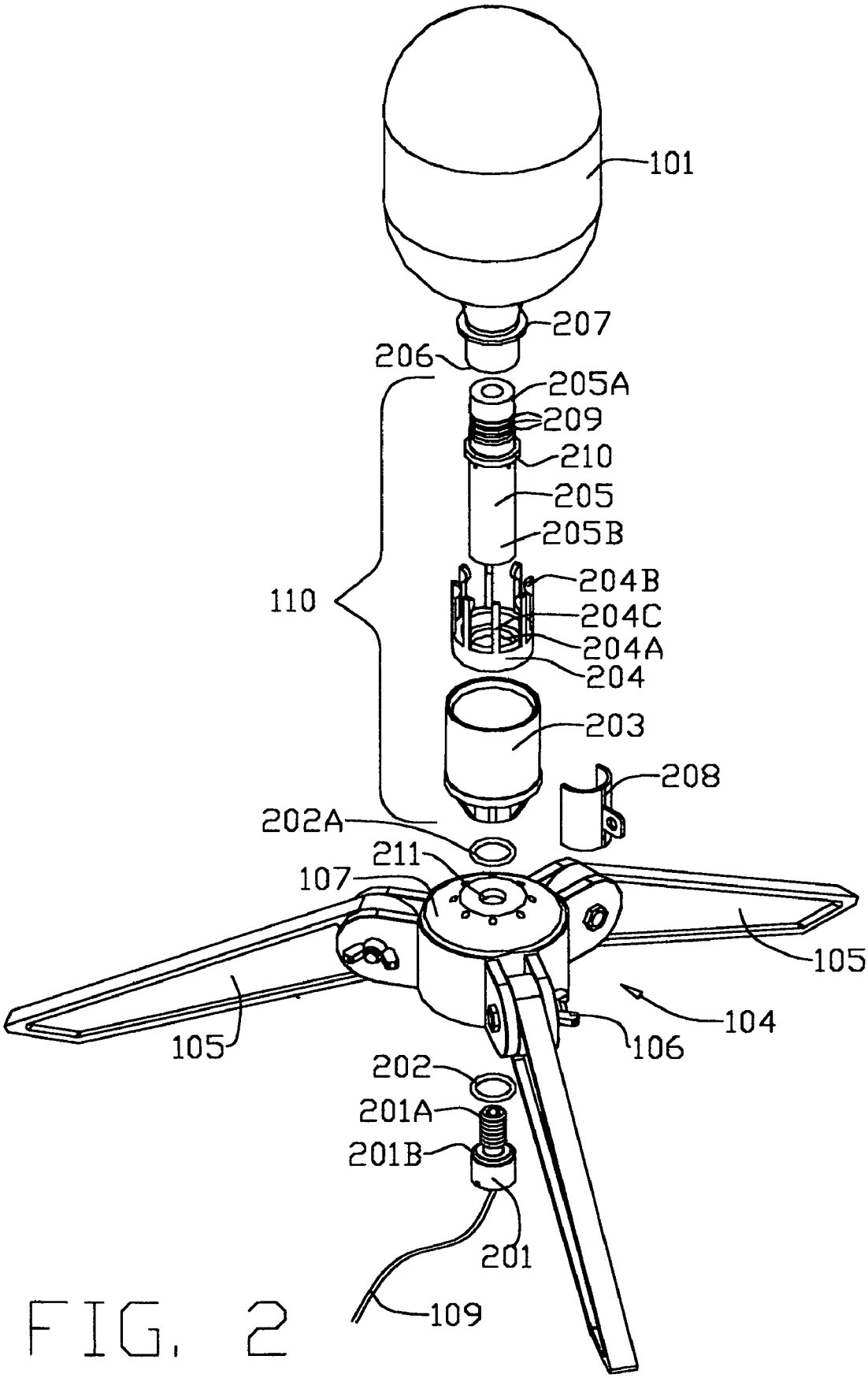
FIG. 2 is an exploded view of a single stage rocket launch system.

Referring to FIG. 2, the capture and release mechanism 110 has a capture and release core 205. The capture and release core 205 has a top 205A and a bottom 205B. The capture and release core top 205A is fitted with a plurality of rocket vessel orifice seal rings 209. The capture and release core top 205A is inserted in the rocket vessel orifice 206 until first-stage rocket vessel 101 mates with the capture and release core step 210. In this position the capture and release core seal rings 209 function to prevent liquid propellant and compressed gas from escaping the first-stage rocket vessel 101.

The flexible retainer mechanism 204 has a central orifice 204A and a plurality of circumferencially placed flexible retainers 204C. Each flexible retainer 204C has a curved tip 204B. Capture and release core bottom 205B is inserted into flexible retainer central orifice 204A until flexible retainer mechanism 204 mates with capture and release core step 210. When the flexible retainer mechanism 204 is in this position the curved tip 204B grips rocket vessel flange 207. The assembled unit is comprised of the first-stage rocket vessel 101, the capture and release core 205 and the flexible retainer mechanism 204. The assembly is slid, as a unit, into the capture and release cup 203 until the capture and release cup 203 inner bottom mates with flexible retainer mechanism 204. When the capture and release cup 203 mates with the said assemble mechanism, the top of the capture and release cup 203 is flush with the top of the flexible retainer mechanism 204. The capture and release fastener 201 is led into the ordinary seal 202 and the entire assembly is fed into bottom of support hub 107 and led into the support hub central orifice 211. The capture and release fastener 201 is led into the support hub central orifice 211 until fastener step 201B mates with inside bottom surface of the support hub 107. Ordinary seal 202A is placed around fastener top 201A and led down until the ordinary seal 202A mates with the top surface of support hub 107. Ordinary seals 202 and 202A prevent liquid propellant and compressed gas from escaping the assembly. The capture and release mechanism 110 is secured to the support structure 104 by anchoring the fastener top 201A into the capture and release core bottom 205B.

In this configuration, the capture and release cup 203 is free to move between the following limits. The capture and release cup 203 is at the upper limit of its' travel when the inside bottom of the capture and release cup 203 mates with the bottom of the flexible retainer mechanism 204. This is the capture position and the pressurized first-stage rocket vessel 101 is prevented from launching. The capture and release cup 203 is at the lower limit of its' travel when the outside bottom of the capture and release cup 203 mates with the top of the support hub 107. This is the release position and the pressurized first stage rocket vessel 101 is no longer restrained. The movement of the capture and release cup 203 is explained in greater detail below. When the capture and release cup 203 is in the capture position, the safety control clip 208 is placed around the capture and release core bottom 205B. The safety control clip 208 when placed around the capture and release core bottom 205B prevents movement of the capture and release cup 203 to its release position and thereby prevents release of the first-stage rocket vessel 101.

Figure 3A:
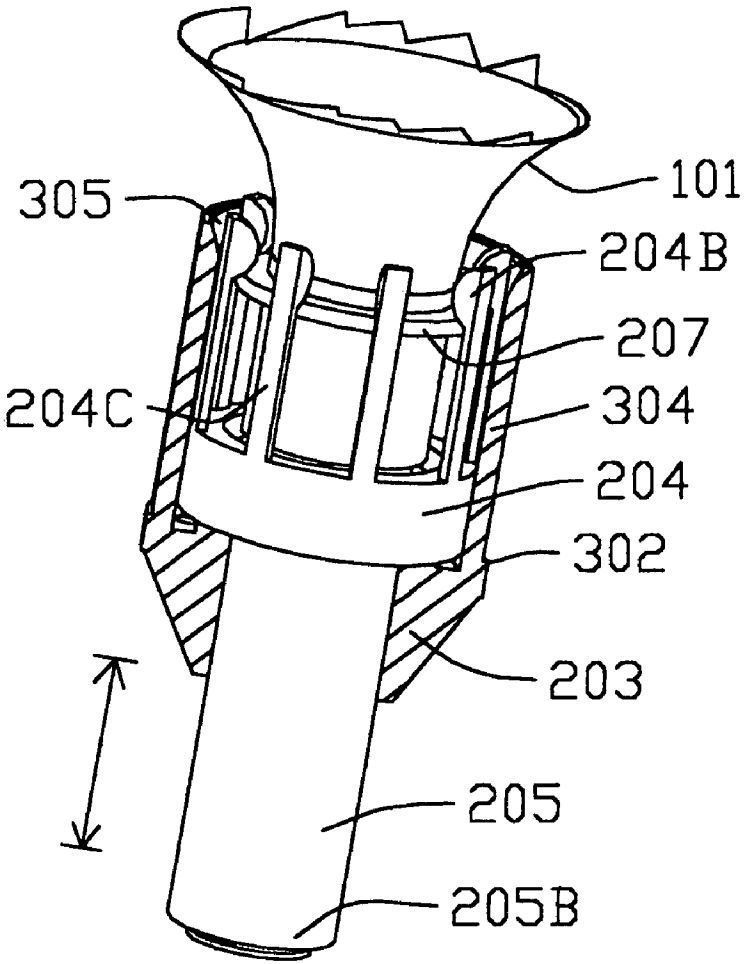
FIG. 3A is a partial cross sectional view of the capture and release mechanism in the lock position.
Figure 3B:
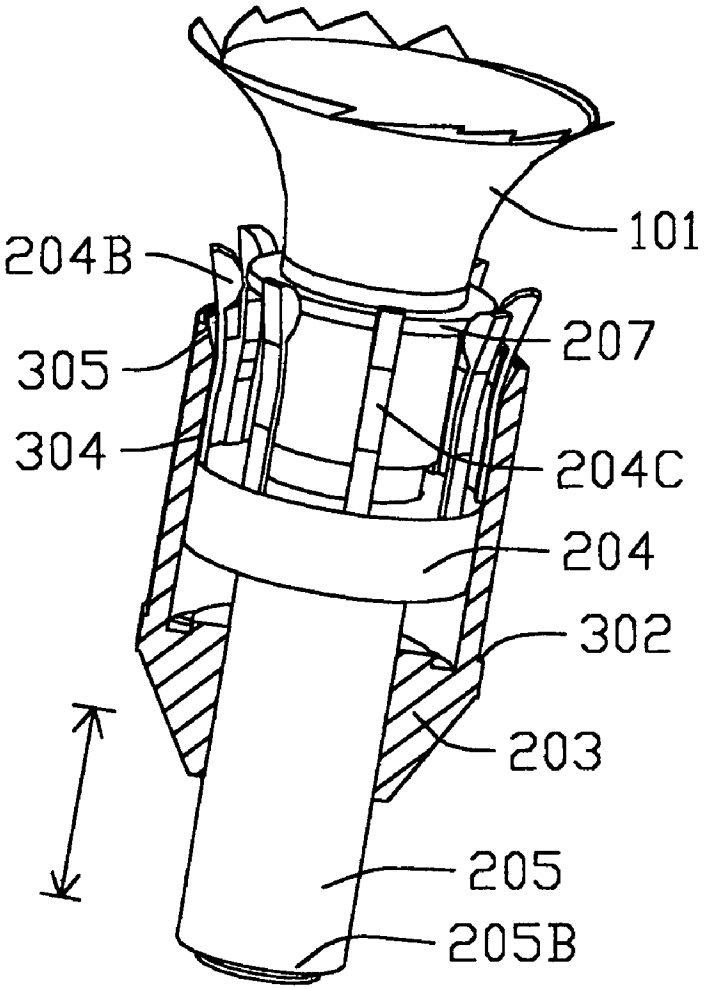
FIG. 3B is a partial cross sectional view of the capture and release mechanism just as the rocket is released.

FIGS. 3A and 3B shows the capture and release mechanism 110 with the capture and release cup 203 cross-sectioned. FIG. 3A shows the capture and release cup 203 in the capture position. When the capture and release cup 203 is in the capture position and the first-stage rocket vessel 101 is charged with liquid propellant and compressed gas, the forces acting on the mechanism must be balanced. The pressure of the compressed gas in the first-stage rocket vessel 101 creates a force tending to separate the first-stage rocket vessel 101 from the capture and release core 205. The first-stage rocket vessel 101 is prevented from separation because the flexible retainer tip 204B extends above the rocket vessel flange 207 and thereby grabs the rocket vessel flange 207. The forces acting between the flexible retainer tip 204B and the rocket vessel flange 207 tend to force the flexible retainer tip 204B radially outward due to the sloped surface of the flexible retainer tip 204B. The flexible retainer tip 204B is prevented from moving radially outward by the capture and release cup sidewall 304. When the safety control clip 208 is removed, the capture and release cup 203 will remain in the capture position. The capture and release cup 203 remains in the capture position due to the friction between the capture and release cup side wall 304 and the plurality of circumferentially placed flexible retainers 204C.

FIG. 3B shows the first-stage rocket vessel 101 just as it is released from the capture and release mechanism 110. If sufficient force is applied, in a direction parallel to the axis of the capture and release cup 203, and away from the rocket vessel, 101, the capture and release cup 203 will move towards the release position. As the capture and release cup 203 begins to move, the flexible retainer tip will begin to move radially outward as the first-stage rocket vessel 101 begins to move upward. The flexible retainers 204C will impart a downward force on the capture and release cup bevel 305. This downward force will cause the capture and release cup 203 to move downward with increased speed. This action allows the flexible retainers 204C to move further radially outward. The outward movement of the flexible retainers 204C causes an increase in the force acting downward on the capture and release cup bevel 305. Therein the capture and release cup 203 is forced to move toward the release position at a greater speed. In other words, the design of the capture and release mechanism 110 is such that any initial downward movement of the capture and release cup 203 creates a downward force on the capture and release cup bevel 305. This downward force on the capture and release cup bevel 305 is created by the outward splaying of the flexible retainers 204C. The advantage is that minimal downward force on the capture and release cup 203 is required to initiate a launch. The first-stage rocket vessel 101 will no longer be constrained from launch at some point in the downward travel of the capture and release cup 203. The capture and release cup 203 has a capture and release cup flange 302. The capture and release cup flange functions as a stop for the coupling plate discussed later.

Figure 4:
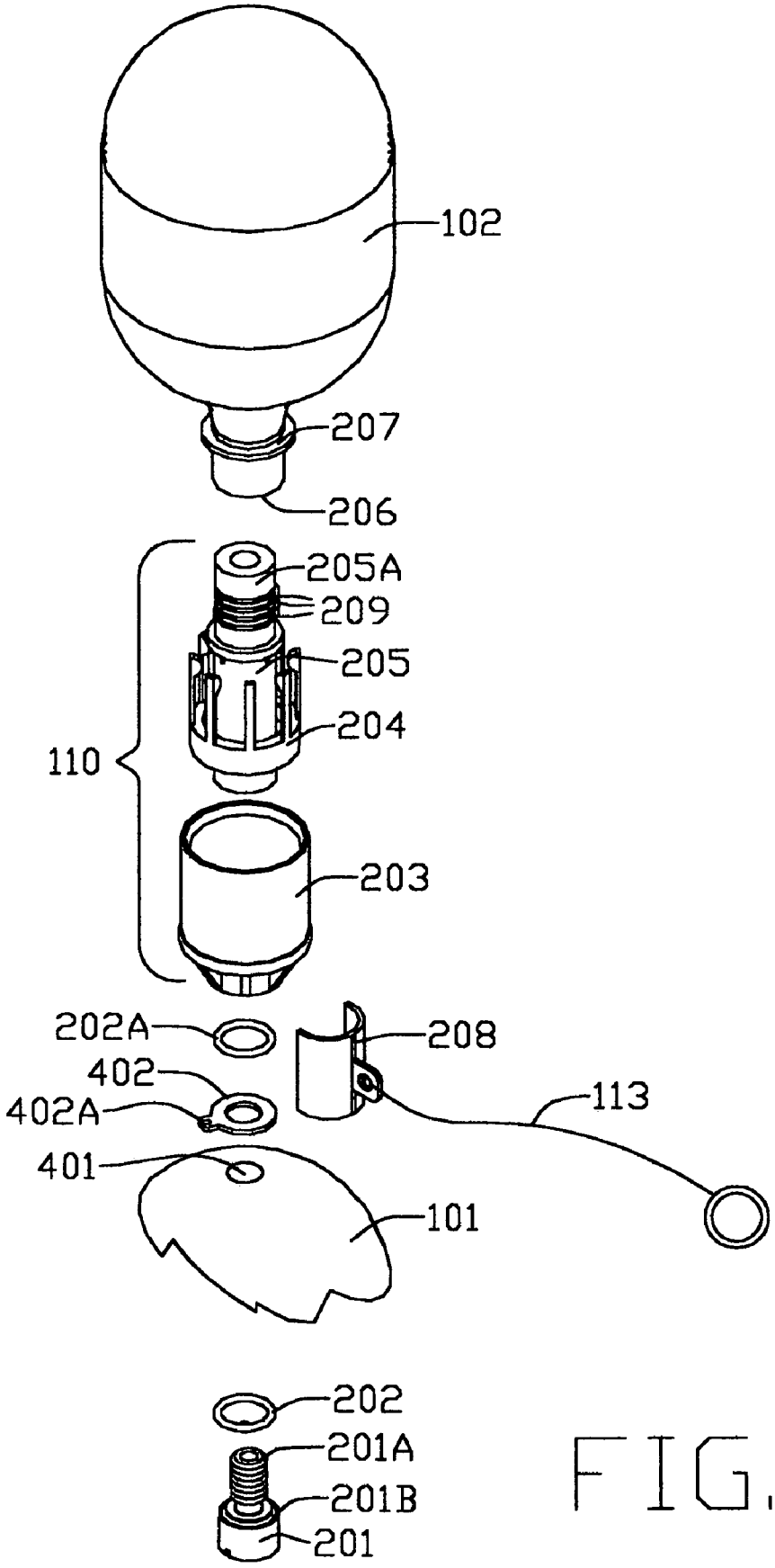
FIG. 4 is an exploded view of a second-stage or subsequent stage capture and release mechanism.

Referring to FIG. 4 the capture and release mechanism 110 is shown as it is mounted on the first-stage rocket vessel 101. The parts are identical to the capture and release mechanism 110 mounted on the support structure 104 with the one addition. The delay device anchor 402. The delay device anchor 402 has an anchor attach tab 402A. The anchor attach tab 402A provides a means of attachment for the stage separation delay device 114 (see FIG. 1). A rocket vessel hole 401 provides a means for securing the capture and release mechanism 110 to the first-stage rocket vessel 101.

To assemble the capture and release mechanism 110, used in a second-stage or subsequent stage application, place the ordinary seal 202 around fastener top 201A until ordinary seal 202 rests against fastener step 201 B. The capture and release fastener 201 is then fed through the rocket vessel orifice 206, of first-stage rocket vessel 101. The fastener top 201A is inserted through the rocket vessel hole 401 until the ordinary seal 202 mates with inside surface of first-stage rocket vessel 101. The delay device anchor 402 is placed around the fastener top 201A until the delay device anchor 402 mates with the top of the first-stage rocket vessel 101. The ordinary seal 202A is placed around the fastener top 201A until the ordinary seal 202A mates with the delay device anchor 402. The remainder of the capture and release mechanism 110 is assembled in the same manner for first-stage operation described above. When assembled the second stage capture and release mechanism 110 is attached to the first-stage rocket vessel 101. The capture and release mechanism 110, in this second-stage application, provides a means for controlling the separation of the second-stage rocket vessel 102 from the first-stage rocket vessel 101. The capture and release mechanism 110 used in this second-stage application also provides a means for compressed gas to flow into the second-stage rocket vessel 102 from the first-stage rocket vessel 101. Back flow of liquid propellant or compressed gas from the second-stage rocket vessel 102 into the first-stage rocket vessel 101 is prevented by the back flow prevention mechanism inside the capture and release fastener 201. The back flow prevention is discussed in greater detail below. It should be noted that the capture and release mechanism 110 used in a third-stage application, or any subsequent stage application, is identical in construction and assembly to the capture and release mechanism 110 used in a second-stage application.

Figure 5:
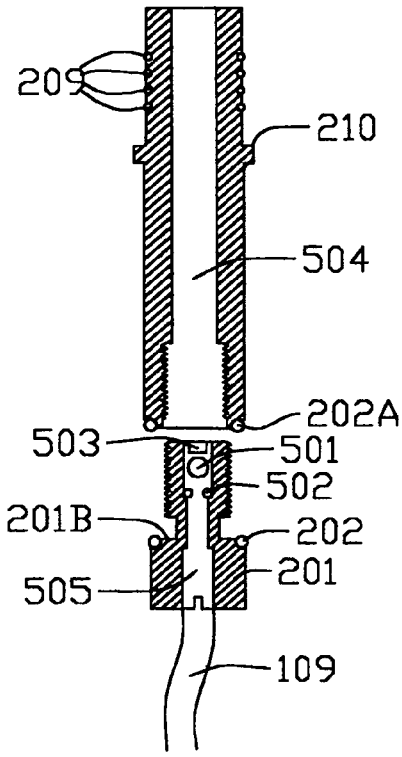
FIG. 5 is a cross sectional view of the capture and release core and a capture and release fastener.

FIG. 5 shows a cross section of the capture and release core 205 and the capture and release fastener 201. The capture and release fastener 201 has a central bore 505, a back flow stop 501, a back flow seal 502 and a back flow stop retainer 503. The back flow stop 501 is free to travel between the back flow seal 502 and the back flow stop retainer 503. The central bore 505 provides a path for fluid passage between the charge line 109, when used in first-stage application, or a path for compressed gas passage when used in any subsequent stage application. When fluid enters the central bore 505 and flows towards the release core central bore 504, the black flow stop 501 is moved towards back flow stop retainer 503. The back flow stop retainer 503 prevents the back flow stop 501 from leaving the capture and release fastener 201. When fluid attempts to flow from the release core central bore 504 back to the release fastener central bore 505 the back flow stop 501 is forced down and mates with the back flow seal 502. This action prevents fluid flow from the release core central bore 504 back to the release fastener central bore 505. Therefore, any liquid propellant or compressed gas that is admitted, therein, to any stage rocket vessel, 101, 102, 103 or subsequent stage, will remain in the rocket vessel. The liquid propellant or compressed gas will remain in the rocket vessel as long as the rocket vessel is in communication with the capture and release mechanism 110.

Figure 6:
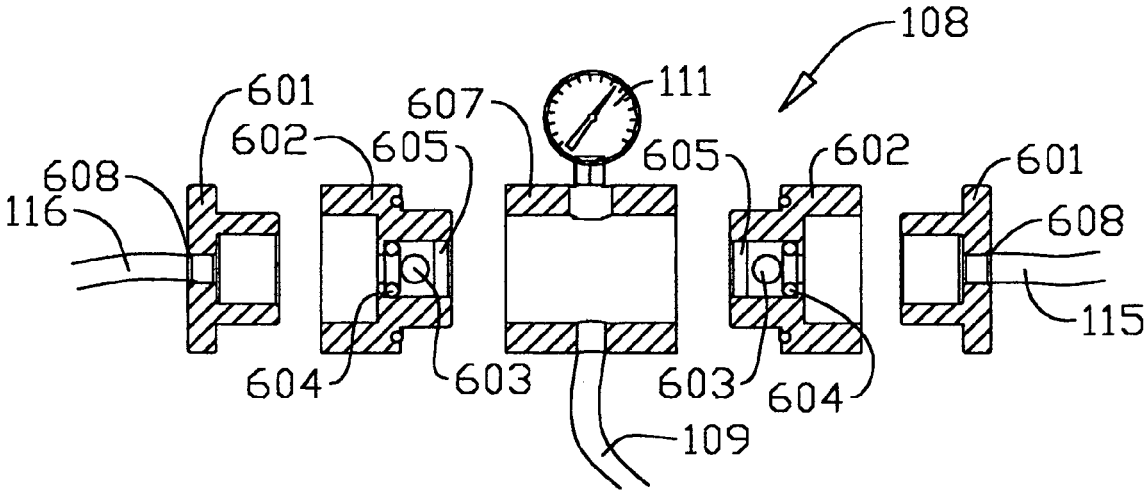
FIG. 6 is a cross sectional view of the charging station.

FIG. 6 shows a cross sectional view of the charging station 108. The charging station 108 has two charging station hose adapters 601, two charging station back flow housings 602 and one charging station central core 607. The charging station hose adapter 601 has a connection orifice 608. The connection orifice 608 provides a connection point for the charging station liquid inlet 115 and the charging station compressed gas inlet 116. The charging station hose adapters 601 are attached to charging station back flow housing 602 by an appropriate mechanical means such as threads or adhesives that will provide a fluid seal. The charging station back flow housing 602 contains a charging station back flow seal 604, a charging station back flow stop 603 and a charging station back flow retainer 605. The charging station back flow stop 603 rests against the charging station back flow retainer 605 when fluid is entering the connection orifice 608. The charging station back flow retainer 605 prevents the charging station back flow stop 603 from leaving the charging station back flow housing 602. When fluid is flowing into one charging station back flow housing 602, from the associated charging station hose adapter 601, the other charging station back flow stop 603 is forced against the charging station back flow seal 604. With the charging station back flow stop 603 against the charging station back flow seal 604 no fluid is allowed to flow from that associated charging station back flow housing 602 into the associated charging station hose adapter 601. Thus fluid flowing into charging station compressed gas inlet 116 is prevented from flowing out of charging station liquid inlet 115. In addition, when liquid is flowing into charging station liquid inlet 115, the liquid is prevented from flowing out of charging station compressed gas inlet 116. It follows that any fluid that enters charging station 108 must exit charging station 108 via charge line 109. The charging station 108 has an ordinary pressure gauge 111 mounted on the charging station central core 607. Placement of the ordinary pressure gauge 111 on charging station central core 607 provides a remote means of pressure measurement that is a safe distance away from the pressurized rocket vessel.

Referring in general to FIG. 1, FIG. 2, FIG. 4, FIG. 5, FIG. 6 and FIG. 7 the operation of the multi-stage rocket launcher 100 is as follows. The pivotable supports 105 on the support structure 104 are adjusted for the desired launch angle. As describe above the capture and release mechanism 110 is attached to the support structure 104. In addition, as described above the capture and release mechanisms 110 are attached to the first-stage rocket vessel 101 and the second-stage rocket vessel 102.

Insert first-stage rocket vessel orifice 206 over the capture and release core 205 that is mounted on support structure 104 until first-stage rocket vessel flange 207 is gripped by the flexible retainer tip 204B. Slide the capture and release cup 203 to the capture position. Place the safety control clip 208 around the capture and release core bottom 205B. The capture and release mechanism 110 that is attached to the support structure 104 is now set in the pre-launch condition.

Fill the second-stage rocket vessel 102 partially full with liquid propellant and insert the second-stage rocket vessel 102 over the capture and release core 205 that is mounted on top of the first-stage rocket vessel 101. Capture the second-stage rocket vessel 102 in the same manner described in the previous paragraph. The second-stage rocket vessel 102 is now in the pre-launch condition.

Fill the third-stage rocket vessel 103 partially full with liquid propellant and insert the third-stage rocket vessel 103 over the capture and release core 205 that is mounted on top of the second-stage rocket vessel 102. The third-stage rocket vessel 103 is captured in the same manner described above. The stage separation delay device 114 is a simple tether in this embodiment. The stage separation delay device 114 is attached to the safety control clip 208 that is clipped to the capture and release core 205 that is mounted on top of the second-stage rocket vessel 102. The other end of the stage separation delay device 114 is attached to the delay device anchor 402, anchor attach point 402A. All three stages of the multi-stage water rocket system are now ready for charging. It should be noted that the above procedure is applicable for single-stage launches as well as two-stage launches, or more stage launches.

The first-stage rocket vessel 101 is charged with liquid propellant by allowing liquid propellant to enter the charging station liquid inlet 115. Liquid propellant will flow into the charging station 108, through charging station internal back flow prevention mechanism internal to the charging station back flow housing 602 and out of charging station 108 via the charge line 109. Liquid propellant flows from the charge line 109 into the release fastener central bore 505. Liquid propellant flows through release fastener central bore 505 and into the release core central bore 504. Liquid propellant exits the release core central bore 504 and enters the first-stage rocket vessel 101. Liquid propellant is allowed to flow until first-stage rocket vessel 101 is partially full of liquid propellant.

First-stage rocket vessel 101, the second-stage rocket vessel 102, and third-stage rocket vessel 103 are simultaneously charged with compressed gas by first allowing compressed gas to flow into the charging station 108 via the charging station compressed gas inlet 116. Compressed gas flows through the charging station 108 internal back flow prevention device that is internal to the charging station back flow housing 602 and exits the charging station 108 via charge line 109. Compressed gas flows into the release fastener central bore 505, of the capture and release fastener 201, that is mounted on the support structure 104. The compressed gas then flows into the release core central bore 504. Compressed gas then enters the first-stage rocket vessel 101.

From the first-stage rocket vessel 101 compressed gas passes through the capture and release mechanism 110 mounted on top of the first-stage rocket vessel 101 in the same manner described in the previous paragraph. The compressed gas then enters the second-stage rocket vessel 102. The compressed gas passes through the capture and release mechanism 110 mounted on the top of the second-stage rocket vessel 102 in the same manner just described. The compress gas then enters the third-stage rocket vessel 103. In this manner, all rocket vessels on all stages are simultaneously charged with compressed gas to the same pressurization level. The multi-stage water rocket system 100 is now ready for launch.

Figure 7:
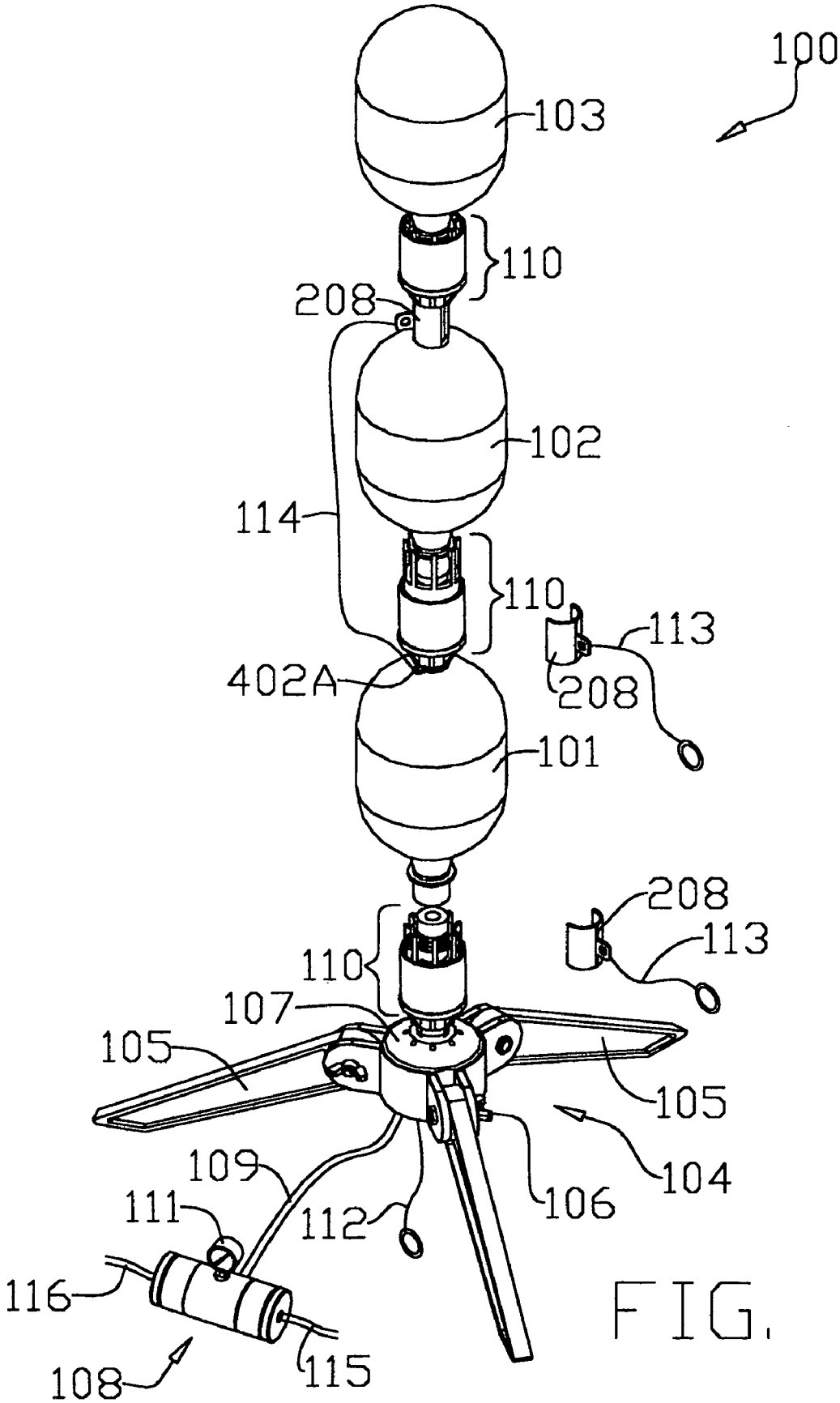
FIG. 7 is an isometric view of a multi-stage rocket system with three stages immediately after launch, just as the rockets are accelerating upward.

Referring to FIG. 7, the operator must first use the safety release device 113 to remove the safety control clip 208, that is associated with the capture and release mechanism 110 mounted on the support structure 104. The other safety release device 113 is used to remove the safety control clip 208 that is associated with the capture and release mechanism 110 mounted on top of the first-stage rocket vessel 101.

Actuating the launch actuating device 112 causes the capture and release cup 203, associated with the capture and release mechanism 110 mounted on the support structure 104, to move to the release position. This will allow the first-stage rocket vessel, 101, the second-stage rocket vessel 102, and the third-stage rocket vessel 103 to accelerate upward as a single unit.

Upon the initial acceleration the capture and release cup 203, associated with the capture and release mechanism 110 mounted on the top of the first-stage rocket vessel, will move to the release position. The second-stage rocket vessel 102 is prevented from separation from the first-stage rocket vessel 101 because the force of acceleration, which acts to keep the stages together, is greater than the force tending to separate the two stages. The force tending to separate the two stages is caused by the compressed gas in the second-stage rocket vessel 102. At some point in the flight the force caused by the compressed gas in the second-stage rocket vessel 102 will exceed the force of acceleration. When the force of the compressed gas, in the second stage rocket vessel 102, exceeds the force of acceleration the second-stage rocket vessel 102 will separate from the first-stage rocket vessel 101. The second-stage rocket vessel 102 will accelerate upward carrying the third-stage rocket vessel 103 and the associated capture and release mechanism 110 with it.

Upon this second-stage separation, the stage separation delay device 114 will remove the safety control clip 208, associated with the capture and release mechanism 110 mounted on top of the second-stage rocket 102. This action occurs at the very start of second-stage rocket vessel 102 separation. The capture and release cup 203, associated with the capture and release mechanism 110, mounted on top of the second-stage rocket vessel 102, is no longer restrained in the capture position. The acceleration forces exerted will cause this capture and release cup 203 to move to the release position. The third-stage rocket vessel 103 will separate in the same manner describe above for the second-stage rocket vessel 102.

It should be noted that this invention would operate with one, two, three or more stage rockets. The invention is not limited to the description above.

The modularity of the capture and release mechanism 110 allows the capture and release mechanism 110 to be used in a parallel launch configuration. The following explanation describes one embodiment of the capture and release mechanism 110 used in a parallel launch configuration. It should be noted that the capture and release mechanism 110 could be used in a parallel launch configuration of any number of rocket vessel configurations. Parallel configurations using first-stage rocket vessels 101, second-stage rocket vessels 102 and third-stage rocket vessels 103 as well as additional stages are possible.

Figure 8:
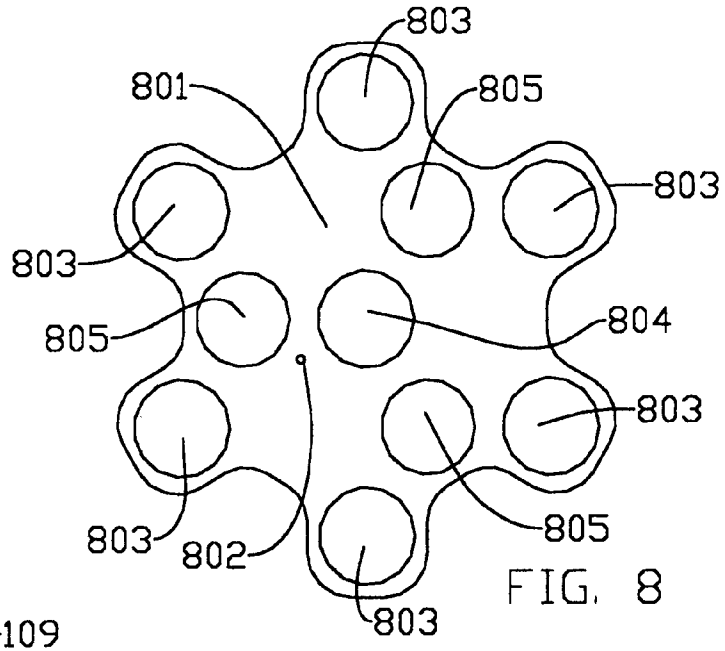
FIG. 8 is top view of a coupling plate use to gang seven or three rocket configurations.

FIG. 8 is a top view of a coupling plate 801. The coupling plate 801 has a launch actuating device orifice 802, coupling plate peripheral orifices 803, a coupling plate central orifice 804, and coupling plate inner orifices 805. The coupling plate 801 is used to connect a number of capture and release mechanisms 110, capture and release cups 203 to each other. When several capture and release cups 203 are connected with a coupling plate 801 only one safety control clip 208 is required to control the launch. Only one launch-actuating device 112 is required to initiate a launch. In order to gang seven, first-stage rocket vessels 101 together the six coupling plate peripheral orifices 803 and the coupling plate central orifice 804 are used to connect the seven capture and release mechanisms 110. To create a parallel launch using three, first-stage rocket vessels 101, the three coupling plate inner orifices 805 are used to connect the three capture and release mechanisms 110. Operation of a parallel launch is discussed in greater detail below.

Figure 9:
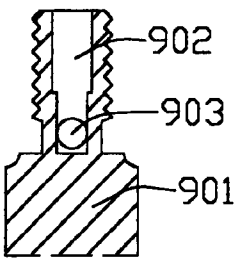
FIG. 9 is a cross sectional view of a capture and release fastener used in parallel launch base showing lateral port for receiving charging fluids.

FIG. 9 is a cross sectional view of a capture and release peripheral fastener 901. The capture and release peripheral fastener 901 has a central bore 902 and a radial bore 903. Charging fluid enters the capture and release peripheral fastener 901 through the radial bore 903 and charging fluid exits the peripheral fastener 901 via the central bore 902. The capture and release peripheral fastener 901 is used to attach the capture and release mechanism 110 for a parallel launch configuration described in greater detail below.

Figure 10:
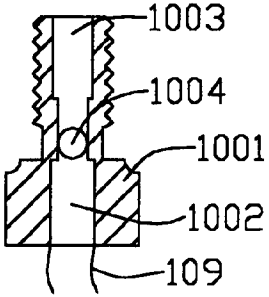
FIG. 10 is a cross sectional view of a capture and release fastener used in the center position of a parallel launch showing charging line and lateral port for supplying peripheral rockets.

FIG. 10 is a cross sectional view of a capture and release central fastener 1001. The capture and release central fastener 1001 has a bottom bore 1002, a top bore 1003, and a radial bore 1004. The charging line 109 is attached to the bottom bore 1002. Charging fluid enters the capture and release central fastener 1001, bottom bore 1002, from the charging line 109. Fluid passes from the bottom bore 1002 and exits the capture and release central fastener 1001 through the top bore 1003. Fluid also exits through the radial bore 1004. Incorporation of the capture and release central fastener 1001 into a parallel launch system is discussed below.

Figure 11:
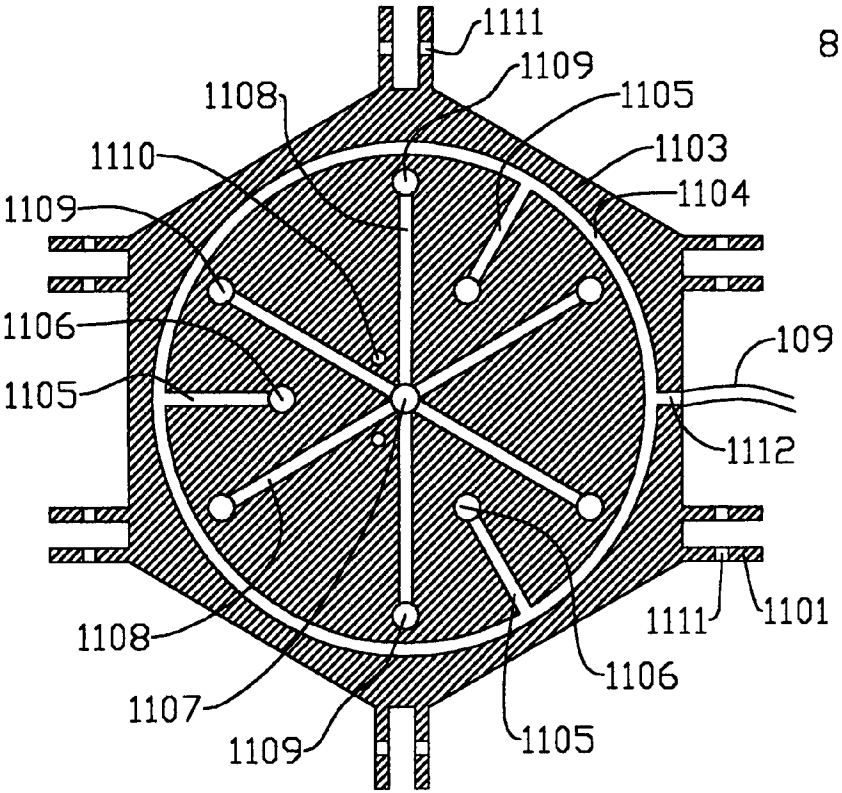
FIG. 11 cross sectional top view of a parallel launch support structure showing internal charging channels.

FIG. 11 shows a cross sectional top view of the parallel launch support structure 1103. The parallel launch support structure 1103 has a plurality of circumferentially placed parallel launch support structure struts 1101. The parallel launch support structure 1103 has a circumferential inner channel 1104, circumferential connecting channels 1105, and radial inner channels 1108. The parallel launch support structure 1103 has a central orifice 1107 and a plurality of circumferentially placed peripheral orifices 1109. The parallel launch support structure 1103 also has an actuating orifice 1110, inner orifices 1106, and a plurality of circumferentially placed strut orifices 1111.

Now referring to FIG. 9, FIG. 10, and FIG. 11, in the embodiment shown, the parallel launch support structure 1103 may be used in a seven, first-stage rocket vessel 101 configuration. Six capture and release mechanisms 110 are attached to the parallel launch support structure 1103 in the support structures peripheral orifices 1109 with capture and release peripheral fasteners 901. The method of attachment is the same as described above for a single capture and release mechanism 110 attachment. The remaining capture and release mechanism 110 is attached to the support structure central orifice 1107 using capture and release central fastener 1001. The method of attachment is the same described above for a single capture and release mechanism 110 attachment.

A plurality of pivotable supports 105 are attached to the parallel launch support structure 1103, with ordinary fasteners 106, by placing pivotable supports 105 between the struts 1101. Pivotable supports 105 are secured by placing ordinary fasteners 106 through the strut orifice 1111 and tightening ordinary fasteners 106. Pivotable supports 105 may be adjusted to accommodate for uneven terrain or to vary the launch angle by moving pivotable supports 105 to desired position and securing with ordinary fasteners 106.

The parallel launch system is completed by placing a coupling plate 801 over the capture and release mechanisms 110, until the coupling plate 801 rests on the capture and release cup flange 302. The final assembly is shown in FIG. 12.

Figure 12:
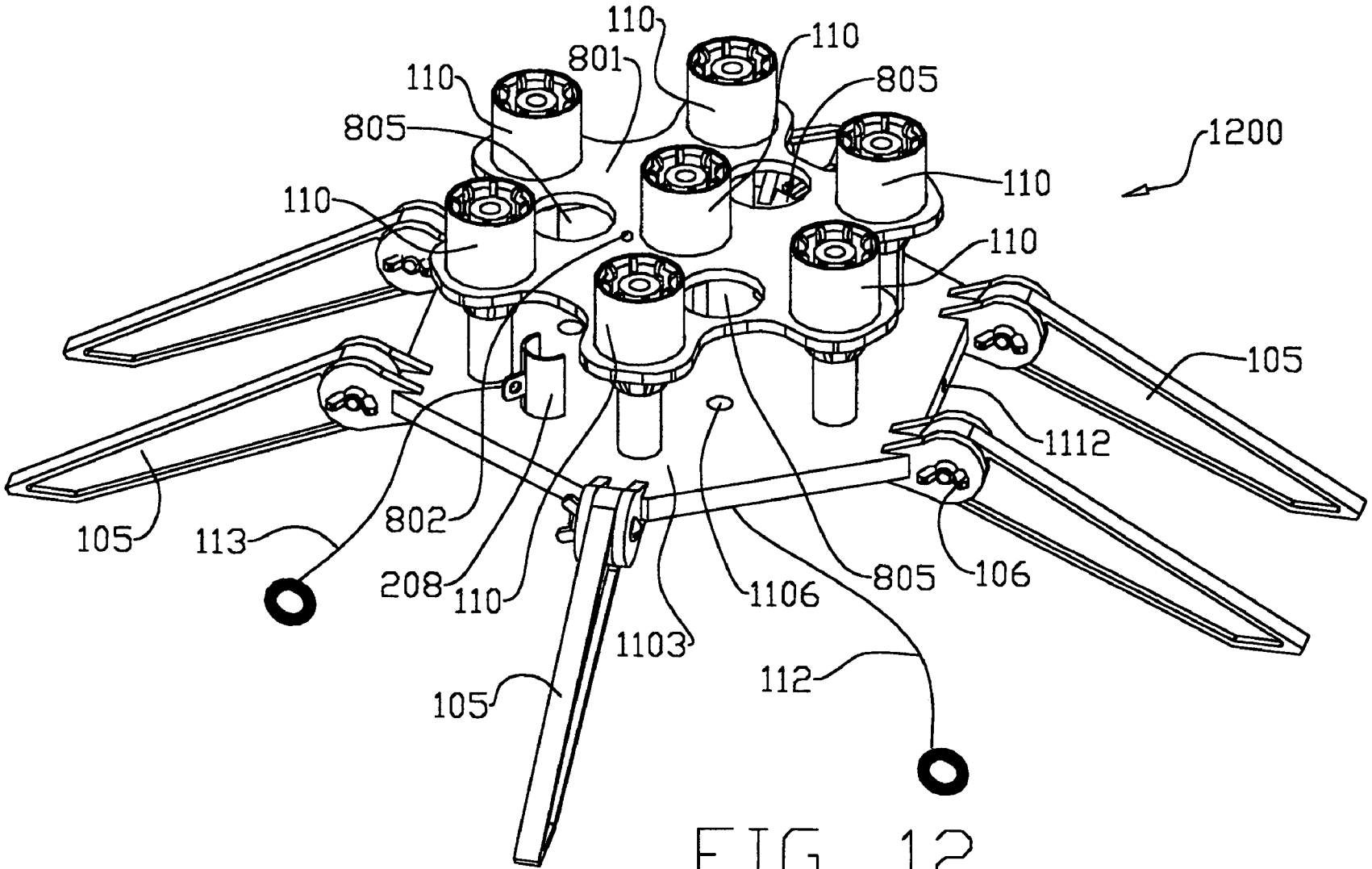
FIG. 12 is an isometric view of a parallel launch system configured for a seven-rocket vessel launch.
Figure 13:
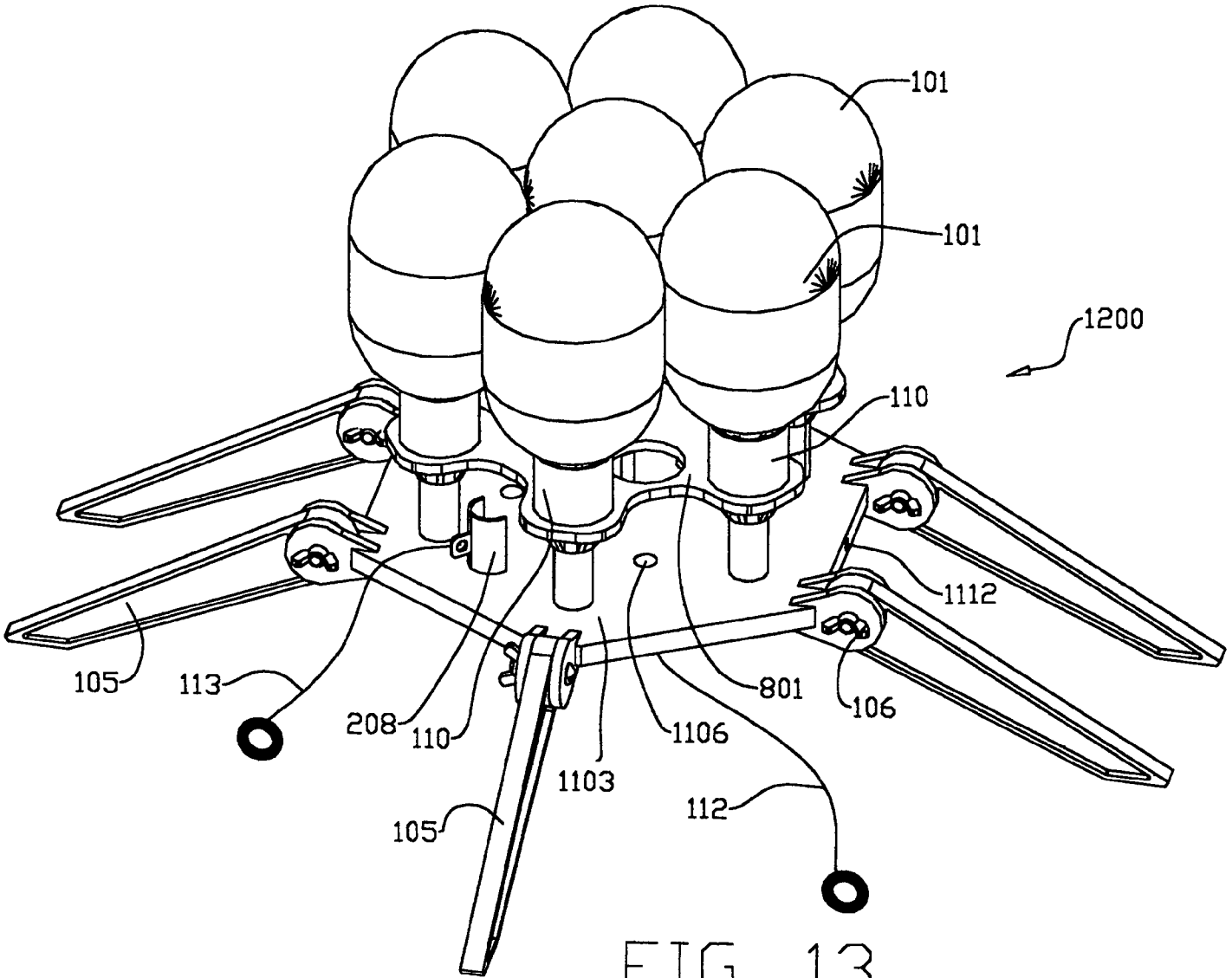
FIG. 13 is an isometric view of a parallel launch system with rocket vessels mounted in the locked position.

Referring to FIG. 12, the coupling plate 801 connects all the capture and release mechanisms 110 together. All the capture and release mechanisms 110 are held in the capture position by a single safety control clip 208. A launch is initiated by a single launch-actuating device 112. In the embodiment shown the launch actuating device 112 is a simple tether which is passed through the support structure actuating orifice 1110 and attached to the coupling plate 801 at the launch actuating device orifice 802. The safety control clip 208 is removed, by actuating the safety release device 113. The coupling plate 801 and the coupled capture and release mechanisms 110 are now free to move downward as a single unit, but are held in the capture position, as described above for a single stage launch. Actuating the launch-actuating device 112 causes the coupling plate 802 to move downward. The coupling plate 802 will transmit this downward movement to all the capture and release mechanisms 110. All capture and release mechanisms 110 will move to the release position simultaneously. Any charged first-stage rocket vessel 110 will then be free to accelerate away from the parallel launch system 1200. A complete description of charging and launching the parallel launch system is described below.

Referring to FIG. 9, FIG. 10, FIG. 11, FIG. 12, and FIG. 13. With the parallel launch system 1200 assembled as described above. The charging of the first-stage rocket vessels 101 is accomplished simultaneously through the charge line 109. The charge line 109 is attached to the capture and release central fastener 1001. The capture and release central fastener 1001 is attached to the center capture and release mechanism 110 via the support structure central orifice 1107. Charging fluid enters the capture and release central fastener 1001 bottom bore 1002 from the charge line 109. Any first-stage rocket vessel 101 in charging communication with the capture and release mechanism 110 that is mounted on the capture and release central fastener 1001 is charged with fluid via the central fastener upper bore 1003. Charging fluid exits the capture and release central fastener 1001 through the central fastener radial bore 1004 and enters the radial inner channels 1108. The charging fluid flows through the radial inner channels 1108 to the capture and release peripheral fasteners 901 mounted in the support structure peripheral orifices 1109. The charging fluid leaves the radial inner channel 1108 and enters the peripheral fastener radial bore 903. The charging fluid then passes into the peripheral fastener central bore 902 and then enters the capture and release mechanism 110 that are in charging communication with the capture and release peripheral fasteners 901. The charging fluid then enters any first-stage rocket vessel 101 captured by the capture and release mechanisms 110. The symmetrical design of the channels in the parallel launch support structure 1103 ensures that all rocket vessels are charge with the same amount of liquid propellant and compressed gas.

For a parallel launch configuration, with three first-stage rocket vessels 101, the capture and release mechanisms 110 are mounted in the support structure inner orifices 1106, using capture and release peripheral fasteners 901. In this configuration, the charge line 109 is connected to lateral orifice 1112. Charging fluid leaves the charge line 109 and enters the lateral orifice 1112. Charging fluid leaves the lateral orifice 1112 and enters circumferential inner channel 1104. Charging fluid flows through the circumferential inner channel 1104 and enters the circumferential connecting channels 1105. The circumferential connecting channels 1105 feed charging fluid into the peripheral fastener radial bore 903, of the capture and release peripheral fasteners 901, that are mounted in the support structure inner orifices 1106. Charging fluid leaves the capture and release mechanism peripheral fastener 901 via the peripheral fastener central bore 902. The charging fluid then enters the capture and release mechanism 110 that is in charging communication with the said capture and release peripheral fasteners 901. The charging fluid then enters the first-stage rocket vessel 101 in the same manner described above.

It should be noted that the invention is not limited to a seven ganged or three-ganged rocket vessel launch described above. The modular design of the lock and release mechanism 110 allows a multiplicity of configurations. Such configurations may be comprised but are not limited to ganged launches consisting of multiple rockets of one, two or more stages simultaneously launched or grouped as a single multi-engine rocket. Subsequent stages may be single or grouped as multi-engine rockets.

What is claimed is:

1. An apparatus for launching bottle rockets, said bottle rockets being pressurizable and comprised of a bottle with an exhaust orifice and a bottle neck with a flange and a bottle bottom, said apparatus comprising:

a) a support structure;

b) a capture and release mechanism;

c) a launch actuating device;

d) a separation delay device;

e) a capture and release fastener;

f) a charging station;

g) a safety control clip;

wherein said support structure is comprised of a plurality of pivotable supports and said capture and release mechanism is mountable and removeable on said support structure and said capture and release mechanism is mountable and removeable on said bottle bottom, said launch actuating device is capable of initiating a launch with said capture and release mechanism, said separation delay device is capable of communication between said capture and release mechanism mounted on said bottle bottom and previous stage bottle rocket, said charging station has liquid propellant and compressed gas inlets and a single outlet, said single outlet is connected to said capture and release fastener, said apparatus launches single-stage or multiple stage bottle rockets.

2. The apparatus of claim 1 wherein said support structure including a plurality of pivotable supports are connected to a support hub by ordinary fasteners.

3. The apparatus of claim 2 further including said pivotable supports that are adjustable to vary the launch angle.

4. The apparatus of claim 2 wherein said support hub has a central orifice which accepts said launch and release mechanism.

5. The apparatus of claim 1 further including said capture and release mechanism with moveable capture and release cup, said moveable capture and release cup is moveable between a release position and a capture position.

6. The apparatus of claim 1 wherein said launch actuating device is comprised of a simple tether or wherein said launch actuating device is comprised of an electrical or electronic device.

7. The apparatus of claim 1 wherein said separation delay device is comprised of a simple tether or said separation delay device is adapted utilizing electrical or electronic means.

8. The apparatus of claim 1 wherein said capture and release fastener has internal mechanism to prevent fluid back flow.

9. The apparatus of claim 1 wherein said charging station has internal mechanisms to prevent fluid back flow.

10. The apparatus of claim 9 further comprising a pressure indicating device mounted on said charging station.

11. The apparatus of claim 1 wherein said capture and release mechanism is further adaptable for launching single stage or multiple stage said bottle rockets.

12. The apparatus of claim 1 wherein said multiple stage rockets are comprised of said capture and release mechanism mounted on said bottle rocket bottom.

13. The apparatus of claim 1 wherein said safety control clip prevents said capture and release mechanism from launching said bottle rocket.

14. The apparatus of claim 1 wherein said safety control clip is controllable a safe distance from said pressurized bottle rocket.

15. The apparatus of claim 14 wherein the controllability of said safety control clip is a simple tether or by electrical or electronic means.

16. An apparatus for capturing and releasing a bottle rocket, said bottle rocket being pressurizable and comprised of a bottle with an exhaust orifice and a bottle neck with a flange and a bottle bottom, said apparatus comprising:

a) a capture and release core;

b) a capture and release cup;

c) a flexible retainer mechanism;

wherein said capture and release core is comprised of a central bore, said central bore directs passage of rocket propellant into said bottle rocket, said rocket propellant is comprised of a suitable liquid such as water and compressed gas, said flexible retainer mechanism is comprised of a plurality of flexible extenders, said flexible retainer has a central orifice, said flexible extenders has a top capable of locking and holding said bottle neck flange, said flexible extenders are capable of radial movement, said capture and release cup has a central orifice, said capture and release cup is shiftably moveable to allow or prevent radial movement of said flexible extenders, said capture and release cup has a bevel on the inside upper rim, said bevel aids in movement of said capture and release cup, said flexible retainer mechanism is assembled on said capture and release core, said capture and release cup is assembled on said capture and release core.

17. The apparatus of claim 16 further comprising a plurality of seal rings mounted on a capture and release core.

18. The apparatus of claim 17 wherein the said seal rings prevent leakage of rocket propellant when said capture and release core is inside said bottle rocket orifice.

19. The apparatus of claim 16 further comprising a mountable bottom on said capture and release core.

20. The apparatus of claim 19 wherein said mountable bottom is mountable on said bottle rocket bottom.

21. The apparatus of claim 19 wherein said mountable bottom is mountable on a multiplicity of support structures.

22. The apparatus of claim 16 wherein said bevel communicates with said flexible extenders to aid in downward movement of said capture and release cup.

23. The apparatus of claim 16 wherein said flexible extenders have a top that grips said bottle neck flange.

24. The apparatus of claim 16 wherein said apparatus for capturing and releasing said bottle rocket is operable on single stage rockets or multiple stage rockets.

25. The apparatus of claim 16 wherein said apparatus for capturing and releasing said bottle rocket is operable with multiple rockets in parallel or multiple rockets in parallel that are ganged together as a single rocket.

26. An apparatus for supporting and coupling a multiplicity of apparatus capable of capturing and releasing a multiplicity of bottle rockets, said bottle rockets being pressurizable and comprised of a bottle with an exhaust orifice and a bottle neck with a flange and a bottle bottom, said apparatus comprising:

a) a coupling plate;

b) a parallel launch support structure;

c) a capture and release central fastener;

d) a capture and release peripheral fastener;

wherein said coupling plate has a plurality of coupling plate orifices, said coupling plate is capable of accepting an apparatus for capturing and releasing said bottle rockets in said plurality of coupling plate orifices, said parallel launch support structure is fitted with a plurality of support structure orifices, said support structure orifices are capable of accepting an apparatus for capturing and releasing said bottle rocket, said parallel launch support structure has internal charging channel for directing charging fluid to said bottle rockets, said capture and release central fastener has internal channels for directing charging fluid to said support structure central internal radial channels, said capture and release central fastener has internal channels for directing charging fluid to said support structure peripheral channels.

27. The apparatus of claim 26 wherein said coupling plate is provided with a single orifice, said single orifice is used as an attachment point for launch release means.

28. The apparatus of claim 26 wherein said parallel launch support structure has a plurality of pivotable supports, said pivotable supports are fastened to said support structure with ordinary fasteners, said pivotable supports are capable of adjusting said support structure to change the launch angle.

29. The apparatus of claim 26 wherein the parallel launch support structure has internal charging channels are circumferentially placed and internal charging channels that are radially placed from a central point.

30. The apparatus of claim 29 wherein the parallel launch support structure internal circumferential charging channel has a lateral port that is connected to an external fluid charging station.

* * * * *